United States Patent [19]

Jencks et al.

[11] 4,087,773

[45] May 2, 1978

[54] ENCAPSULATED SOLENOID

[75] Inventors: Hollis W. Jencks; David C. Jencks, both of Pleasant Ridge; Ralph M. Burton, Grosse Pointe, all of Mich.

[73] Assignee: Detroit Coil Company, Ferndale, Mich.

[21] Appl. No.: 741,979

[22] Filed: Nov. 15, 1976

[51] Int. Cl.[2] ..... H01F 7/10

[52] U.S. Cl. ..... 335/243; 335/251; 335/260

[58] Field of Search ..... 335/245, 248, 251, 255, 335/260, 262, 278, 282, 299; 336/198

[56] References Cited

U.S. PATENT DOCUMENTS

| | | | |
|---|---|---|---|
| 3,082,359 | 3/1963 | Mangiafico et al. | 335/260 X |
| 3,331,042 | 7/1967 | Erickson et al. | 335/260 |
| 3,757,263 | 9/1973 | Saarem et al. | 335/262 X |
| 3,837,618 | 9/1974 | Juhel | 335/255 X |

*Primary Examiner*—George Harris

*Attorney, Agent, or Firm*—Burton, Parker & Schramm

[57] ABSTRACT

An alternating current solenoid having a quadriateral frame and a coil-wound plastic bobbin disposed therein is encapsulated in a resin block opening outwardly at one end with a pole piece extending into the block through such end and through the frame and into a plunger guideway formed by the barrel of the bobbin, the opposite end of the block interiorally defining an extension of the guideway and closing the end thereof remote from the pole piece.

5 Claims, 6 Drawing Figures

ENCAPSULATED SOLENOID

FIELD OF INVENTION

This invention relates to an improved alternating current solenoid.

BACKGROUND OF THE INVENTION

There have been essentially two approaches in the prior art to the design of resin encapsulated A.C. industrial solenoids. One is typified by U.S. Pat. No. 3,605,054 and the other by U.S. Pat. No. 3,633,139. In the former, the coil and laminated frame are encapsulated in a resin block, the plunger is inserted and a hollow cap is then secured to the block over the plunger head, sufficient space being provided within the cap to allow reciprocation of the plunger head. The block is then secured to the device to be actuated. In the latter patent, the plunger is contained in an armature tube closed at one end and secured at the other to the device to be operated. The coil and laminated frame are encapsulated in a resin block having an aperture extending therethrough and the block is telescoped over the tube and secured thereto. In both instances essentially all that is resin encapsulated is the coil and field frame and other parts must be added to complete the housing for the plunger.

SUMMARY OF THE INVENTION

We have developed a design for a solenoid wherein not only are the coil and frame encapsulated but, in addition, the encapsulation is so constructed that no separate cap is required, no plunger guide tube is needed, only that the plunger and a pole piece be inserted into the block and then the solenoid is ready for mounting on the device to be actuated. Costs of manufacture and assembly are substantially reduced and other advantages obtained that will be apparent to those skilled in the art from the following description of a solenoid embodying our invention.

BRIEF DESCRIPTION OF PREFERRED EMBODIMENTS

Figure 1:
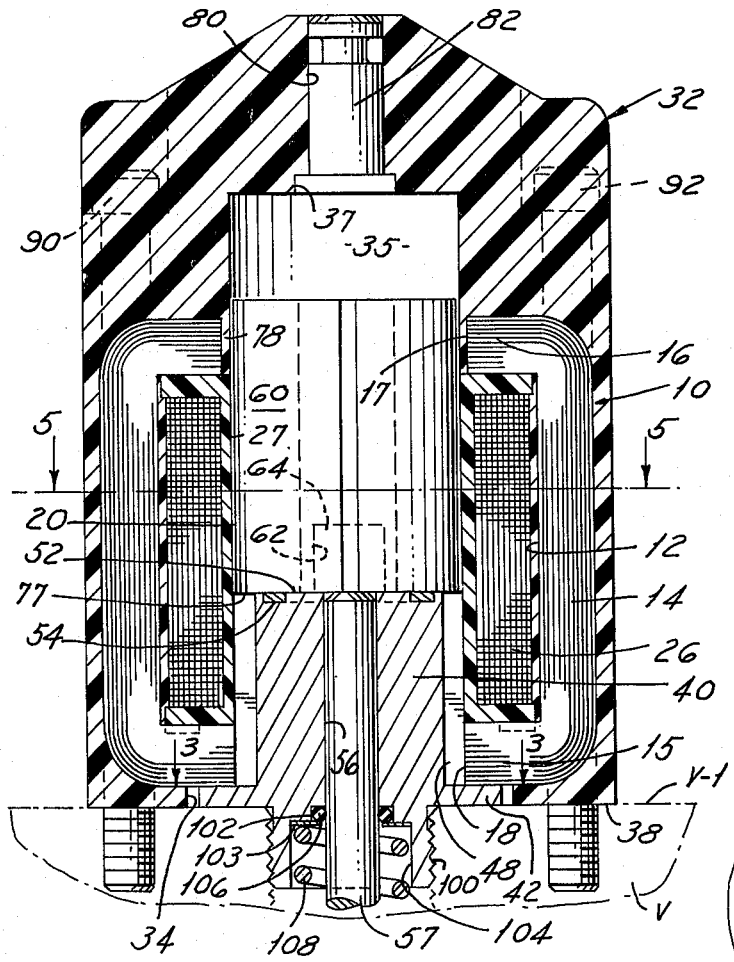
FIG. 1 is a cross-sectional view through a solenoid embodying our invention taken on the Line 1—1 of FIG. 2.
Figure 5:
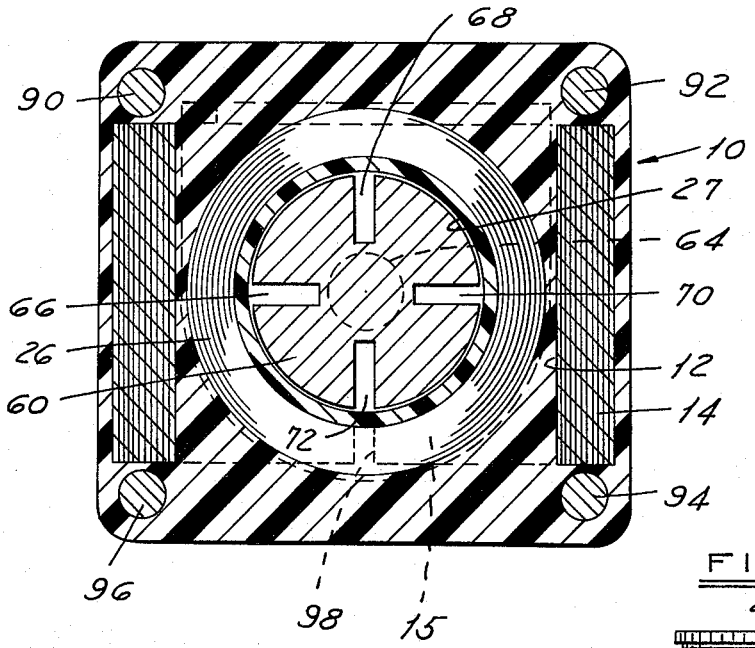
FIG. 5 is a cross-sectional view of the plunger taken on the Line 5—5 of FIG. 3.
Figure 6:
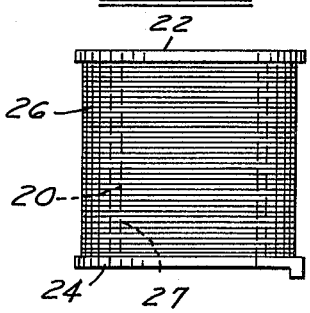
FIG. 6 is a side elevation of a coil wound bobbin for use in the solenoid.

Our improved solenoid comprises a rectangular or quadrilateral frame 10 shown in FIGS. 1 and 5 having a central coil opening 12 formed by wrapping a ribbon of silicon steel 14 upon itself through a number of convolutions. A pair of opposite sides 15 and 16 are provided with centrally arranged, opposed, aligned cylindrical apertures 17 and 18 extending from the opening 12 completely through the convolutions. A coil wound plastic bobbin shown in FIG. 6 is received in the central opening 12 of the frame. The bobbin is preferably formed of nylon, though other suitable plastics may be utilized. It has a cylindrical barrel portion 20 and opposed integral end flanges 22 and 24 between which the coil 26 is wound. The interior of the barrel defines a cylindrical plunger guideway 27 which is aligned with the apertures 17 and 18 of the frame. Magnet wires (not shown) may extend from the coil to terminate in electric terminal pins 28 and 30 for connection in complementary female sockets on the device to be actuated similar to the arrangement shown in FIGS. 13 and 14 of U.S. Pat. No. 2,975,340.

The frame 10, coil wound bobbin, and terminal pins are all integrated in a single structural assembly by encapsulation in a resin block 32. Such encapsulation may be effected by transfer molding, vacuum molding, or simple casting, utilizing a conventional epoxy resin which may be either a casting or molding resin containing a glass or other suitable filler. While an epoxy resin has been mentioned, any resin having the requisite structural integrity, thermal conductivity and heat resistivity to withstand continuous operation of the solenoid, may be utilized. The encapsulation should be accomplished in such fashion as to cause the resin to enter all the interstices between the various surfaces of the parts to provide a strong, well-supported, block-like structure.

At the time of casting the block 32 the apertures 17 and 18 of the frame are plugged as is the plunger guideway 27 to prevent the casting resin from covering the surfaces thereof. Furthermore, the casting or molding operation should provide for the forming of cylindrical opening 34 larger than but concentric with aperture 18 and communicating between the adjacent side 15 of the frame, around the aperture 18, and the outside bottom surface 38 of the block. Also at the time of casting provision should be made for forming within the opposite end of the block 32 a hollow chamber 35 having an inside diameter corresponding with that of the guideway 27 and forming an extension thereof. The block may be cast with a skirt 78 or sleeve means which is either of the same material as the block and formed during the casting operation, or a separate element of the same material as the bobbin barrel 20, which is inserted into the casting mold and held in position during the casting operation to become an integral but separate part with the block. The skirt or sleeve means 78 bridges across the aperture 17 in the frame side 16 between the plunger guideway 27 and the encircling cylindrical surface of the chamber 35. The chamber 35 opens outwardly through a counterbore 37 and a central bore 80. Both such bores may be formed at the time of the block casting operation. The sleeve means 78 is relatively thin walled and is a snug fit in the frame aperture 17 to provide a narrow air gap between the plunger and frame at such aperture.

According to one method of encapsulation the coil wound bobbin and frame 10 may be assembled and inserted over a mandrel. A nylon sleeve 78 may also be inserted on the mandrel and within aperture 17. The mandrel will have portions of various diameters to form the apertures, counterbores and chamber 35 above described and will fit through the frame and plunger guideway. The mandrel with parts thus assembled thereon is then positioned in a suitably shaped mold and the casting resin admitted thereto. Following hardening or curing of the resin the mandrel is withdrawn from the solidified block.

A cylindrical, solid (non-laminated), pole piece or stop 40 is press-fitted into the aperture 18 of the frame to make snug contact with the frame. A flange 42 on the lower end of the pole piece fits within the opening 34 to abut the frame side 15 and lie flush with the bottom surface 38 of the block. The other end of the pole piece projects into the plunger guideway 27.

The pole piece is provided with a plurality of longitudinally extending slots 44–50 for the purpose of reducing eddy current losses. Its upper or inner end 52 is provided with an annular concentric groove spaced from the slots 44–50. In such groove a shading coil 54 of copper is brazed or otherwise suitably fixed in place. The pole piece is also shown as being provided with an axial bore 56 for receiving a push-pin 57 for transmitting motion between the solenoid plunger and the device to be actuated.

Supported in the guideway 27 for reciprocal movement is a solid (non-laminated), cylindrical solenoid plunger 60. The plunger may be slightly chamfered at its lower end and provided with a central cylindrical pocket 62 in which is secured by brazing or in any other suitable fashion a tool steel anvil 64 for abutting the upper end of the aforementioned push-pin. The plunger is also provided with a plurality of longitudinally extending slots 66–72 as best shown in FIGS. 1 and 5 for reducing eddy current losses and also equalizing pressures at opposite ends of the plunger during rapid shifting thereof.

As the plunger is supported by the guideway 27 in the bobbin barrel and the thin wall sleeve means 78 only a minimum air-gap consistent with the smooth sliding action exists between the plunger and the upper side 16 of the frame. The principle air-gap will be the working gap created between the confronting ends 77 and 52 of the plunger and pole piece when the plunger is shifted upwardly away from the pole piece as by the upward force of the push-pin thereagainst.

The solenoid is retained on the device to be actuated, indicated at V, by four bolts or the like 90, 92, 94, and 96 which extend through suitable apertures in the block and are threaded into the device V.

Both sides of the frame 15 and 16 may be provided with a transverse slot, as for example slot 98 shown in FIG. 5 through the side 15 of the frame, which extends fron one edge of the frame to the central apertures 17 and 18. Such slots will reduce eddy current losses in the frame 10.

It will be noted that when the solenoid is secured to the device to be operated, the wide flanged end 42 of the pole piece will be sandwiched between the frame end 15 and a surface V-1 of the device, and that as the end 77 of the plunger strikes the pole piece the force will be transmitted, not to the solenoid, but to the surface of the device to be operated. Unlike the structure in U.S. Pat. No. 3,633,139, all forces are transmitted in a compression mode directly to the device to be actuated, rather than in shear.

Figure 3:
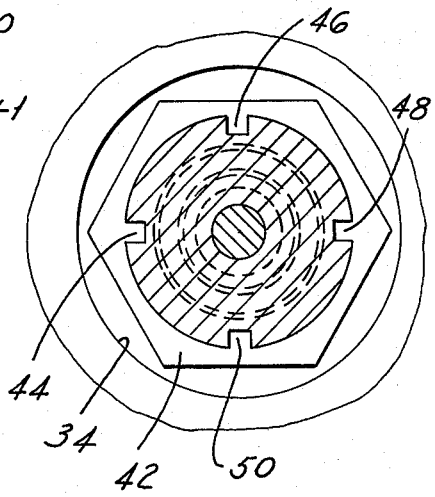
FIG. 3 is a cross-sectional view taken on the Line 3—3 of FIG. 1.
Figure 2:
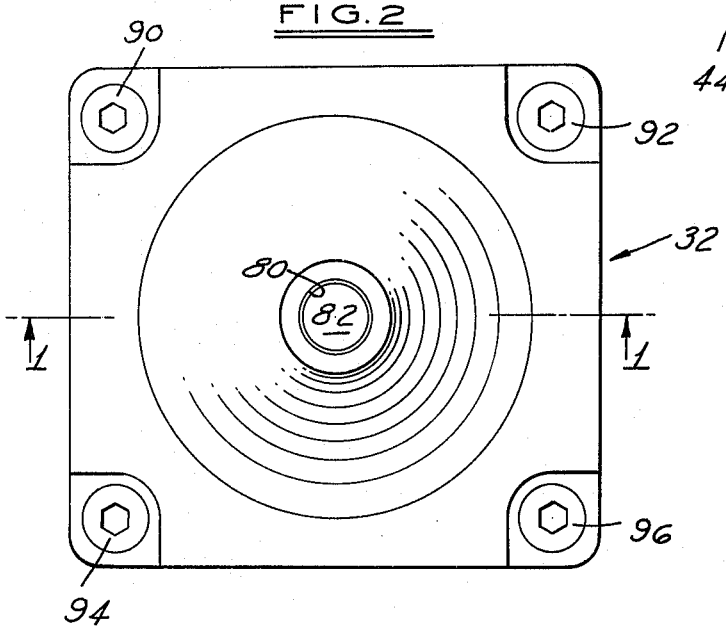
FIG. 2 is a top plan view of the solenoid shown in FIG. 1.
Figure 4:
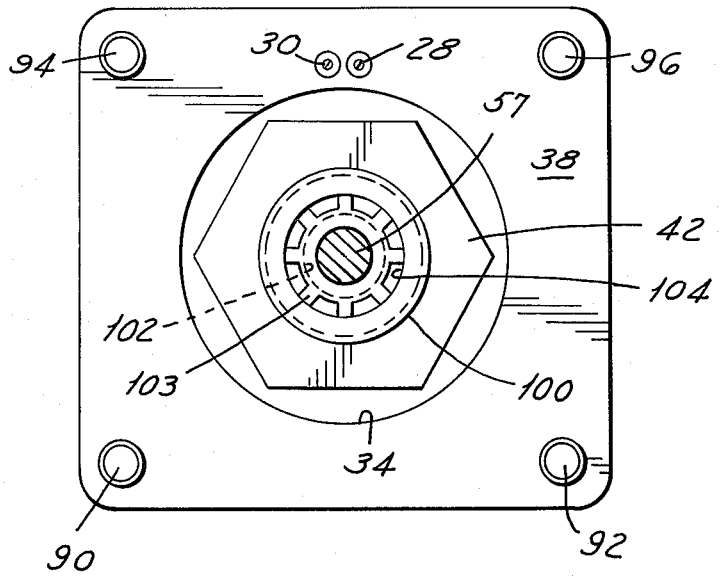
FIG. 4 is a bottom view of the solenoid shown in FIG. 1.

If desired the flange 42 may be polygonal as shown in FIG. 3 to receive a wrench, and the pole piece below the flange may be externally threaded as at 100 for threaded reception in the device V. Such end of the pole piece may be counterbored at 102 and 104. Counterbore 102 is adapted to receive an O-ring or the like seal to exclude fluid in device V from migrating upwardly into the solenoid along bore 56. The O-ring may be retained in place by a washer 103 press fitted into the counterbore 104. A spring 108 being a part of the mechanism of device V may bear against the washer. This arrangement will allow removal and replacement of the block and plunger 60 without disturbing the device V and the pole piece may be a structural part of the device V.

The selection of nylon for the bobbin results in a plunger guideway having a low coefficient of friction so the plunger may reciprocate freely therein. Should operating temperatures exceed safe limits for nylon, then a thermosetting plastic of suitable toughness, low coefficient of friction and good wearability may be used.

Unlike prior art constructions wherein a continuous metal tube extends through the coil and frame and either effectively provides a shorted turn thereby increasing wattage or increases the air gap, the absence of such tube in the present construction and the positioning of the pole piece and the snug fit thereof in one side of the frame, together with only a thin air gap between the plunger and opposite side of the frame promotes good magnetic efficiency. Losses are also reduced, of course, by the provision of the slots in the pole piece, plunger, and frame.

It will be apparent from the foregoing description that instead of a cylindrical plunger guideway 27 the bobbin may have a square or rectangular barrel portion thereby permitting use of a correspondingly shaped plunger. Such a plunger may be made of steel laminations if desired, to reduce eddy current losses. The pole piece 40 would, of course, be correspondingly shaped, and of laminated construction, or not, as desired. It is to be understood that such modifications would tend to increase costs of the solenoid.

What is claimed is:

1. An alternating current solenoid comprising, in combination:

a quadrilateral frame having a central coil receiving opening with a pair of opposite sides having aligned apertures opening therethrough, a coil received in the central opening of the frame, a tubular plastic element extending axially through the coil and defining a cylindrical plunger guideway aligned with said apertures, said frame and coil and tubular plastic element encapsulated in a resin block having an opening at one end thereof aligned with an adjacent one of said apertures in the frame and interiorally hollow at the opposite end to provide a plunger receiving cylindrical chamber aligned with the opening at the opposite side of the frame and forming a continuation of the guideway to receive and support the end of the plunger in the guideway, said chamber having an end wall integrally formed with the block extending transversely across the chamber to limit movement of a plunger entering the chamber, a non-laminated pole piece received through the open end of the block and extending in a snug fit through said adjacent one of said apertures in the frame and projecting into the plunger guideway, a non-laminated plunger received in the guideway and supported thereby for reciprocation between the pole piece and the said chamber, and said pole piece having a radially extending flange portion underlying said frame around the aperture through which the pole piece extends with said flange abutting the frame, said flange being outwardly exposed through the resin block to abut in a compression mode the surface of the device to be actuated whereby when the block is mounted on such device the flange is sandwiched and retained between such device and the adjacent side of the frame.

2. An alternating current solenoid comprising, in combination:

a quadrilateral frame having a central coil receiving opening with a pair of opposite sides having aligned apertures opening therethrough, a coil received in the central opening of the frame, a tubular plastic element extending axially through the coil and defining a cylindrical plunger guideway aligned with said apertures, said frame and coil and tubular plastic element encapsulated in a resin block having an opening at one end thereof aligned with an adjacent one of said apertures in the frame and interiorally hollow at the opposite end to provide a plunger receiving cylindrical chamber aligned with the opening at the opposite side of the frame and forming a continuation of the guideway to receive and support the end of the plunger in the guideway, said chamber having an end wall integrally formed with the block extending transversely across the chamber to limit movement of a plunger entering the chamber, a non-laminated pole piece received through the open end of the block and extending in a snug fit through said adjacent one of said apertures in the frame and projecting into the plunger guideway, a non-laminated plunger received in the guideway and supported thereby for reciprocation between the pole piece and the said chamber, and said pole piece having that end opposed to the plunger provided with an annular shading coil, and said plunger having that end opposed to the pole piece provided with a hardened steel anvil insert.

3. An alternating current solenoid comprising, in combination:

a quadrilateral frame having a central coil receiving opening with a pair of opposite sides having aligned apertures opening therethrough, a coil received in the central opening of the frame, a tubular plastic element extending axially through the coil and defining a cylindrical plunger guideway aligned with said apertures, said frame and coil and tubular plastic element encapsulated in a resin block having an opening at one end thereof aligned with an adjacent one of said apertures in the frame and interiorally hollow at the opposite end to provide a plunger receiving cylindrical chamber aligned with the opening at the opposite side of the frame and forming a continuation of the guideway to receive and support the end of the plunger in the guideway, said chamber having an end wall integrally formed with the block extending transversely across the chamber to limit movement of a plunger entering the chamber, a non-laminated pole piece received through the open end of the block and extending in a snug fit through said adjacent one of said apertures in the frame and projecting into the plunger guideway, a non-laminated plunger received in the guideway and supported thereby for reciprocation between the pole piece and the said chamber, and said pole piece having an externally threaded outer end portion for threaded engagement in the device to be actuated.

4. An alternating current solenoid comprising, in combination:

a quadrilateral frame having a central coil receiving opening with a pair of opposite sides having aligned apertures opening therethrough, a coil received in the central opening of the frame, a tubular plastic element extending axially through the coil and defining a cylindrical plunger guideway aligned with said apertures, said frame and coil and tubular plastic element encapsulated in a resin block having an opening at one end thereof aligned with an adjacent one of said apertures in the frame and interiorally hollow at the opposite end to provide a plunger receiving cylindrical chamber aligned with the opening at the opposite side of the frame and forming a continuation of the guideway to receive and support the end of the plunger in the guideway, said chamber having an end wall integrally formed with the block extending transversely across the chamber to limit movement of a plunger entering the chamber, a non-laminated pole piece received through the open end of the block and extending in a snug fit through said adjacent one of said apertures in the frame and projecting into the plunger guideway, a non-laminated plunger received in the guideway and supported thereby for reciprocation between the pole piece and the said chamber, and said pole piece having an axially extending push pin receiving bore opening through opposite ends thereof in alignment with the plunger.

5. An alternating current solenoid comprising, in combination:

a quadrilateral frame having a central coil receiving opening with a pair of opposite sides having aligned apertures opening therethrough, a coil received in the central opening of the frame, a tubular plastic element extending axially through the coil and defining a cylindrical plunger guideway aligned with said apertures, said frame and coil and tubular plastic element encapsulated in a resin block having an opening at one end thereof aligned with an adjacent one of said apertures in the frame and interiorally hollow at the opposite end to provide a plunger receiving cylindrical chamber aligned with the opening at the opposite side of the frame and forming a continuation of the guideway to receive and support the end of the plunger in the guideway, said chamber having an end wall integrally formed with the block extending transversely across the chamber to limit movement of a plunger entering the chamber, a non-laminated pole piece received through the open end of the block and extending in a snug fit through said adjacent one of said apertures in the frame and projecting into the plunger guideway, a non-laminated plunger received in the guideway and supported thereby for reciprocation between the pole piece and the said chamber, and means in said transversely extending end wall of the chamber for engaging the plunger and manually operable to actuate the same.

* * * * *